US006386903B1

(12) United States Patent
Grossman

(10) Patent No.: US 6,386,903 B1
(45) Date of Patent: May 14, 2002

(54) TERMINAL POSITION ASSURANCE ASSEMBLY FOR ROOF MARKER LAMP

(75) Inventor: Vitaly Grossman, West Bloomfield, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/677,333

(22) Filed: Sep. 28, 2000

(51) Int. Cl.[7] ..... H01R 13/00
(52) U.S. Cl. ..... 439/483; 439/34; 439/476.1
(58) Field of Search ..... 439/483, 484, 439/477, 476.1, 34; D13/138.1

(56) References Cited

U.S. PATENT DOCUMENTS

D206,800 S * 1/1967 Goldbaum et al. ..... 439/476.1
4,516,824 A * 5/1985 Winogrocki et al. ..... 439/476.1
4,573,754 A * 3/1986 Hill ..... 439/699.2
4,859,194 A * 8/1989 Bartholomew ..... 439/483
6,109,953 A * 8/2000 Hashigaya et al. ..... 439/483

* cited by examiner

*Primary Examiner*—Tho D. Ta
(74) *Attorney, Agent, or Firm*—Laura C. Hargitt

(57) ABSTRACT

A terminal position assurance assembly is provided for connection to an electrical connector of a roof marker lamp for a vehicle. The terminal position assurance assembly includes an electrical connector for connection to the electrical connector of the roof marker lamp. The terminal position assurance assembly also includes a terminal position assurance member connected to the electrical connector and having a handle portion extending outwardly to be gripped by an assembler to assist the assembler in connecting the electrical connector to the electrical connector of the roof marker lamp.

16 Claims, 2 Drawing Sheets

FIG 1
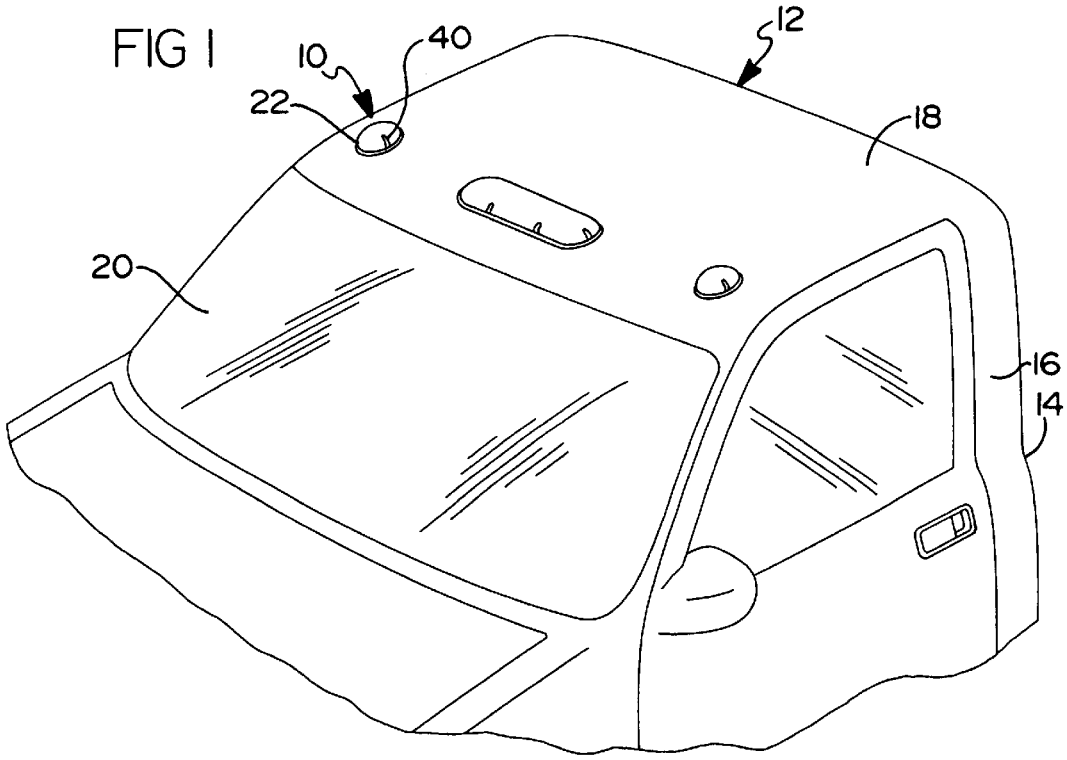
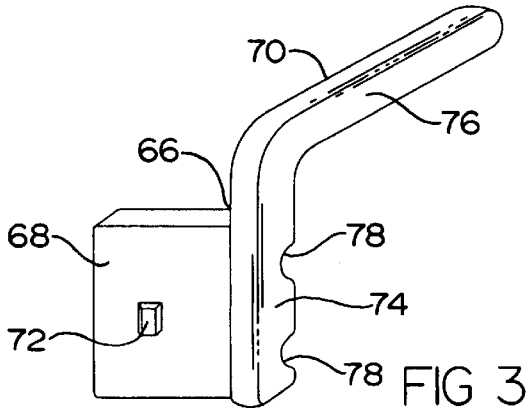
FIG 3

FIG 4
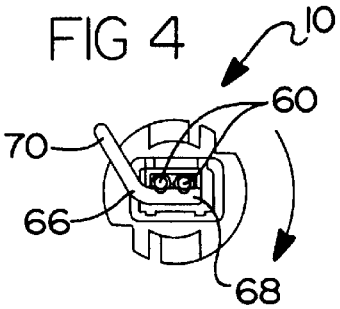
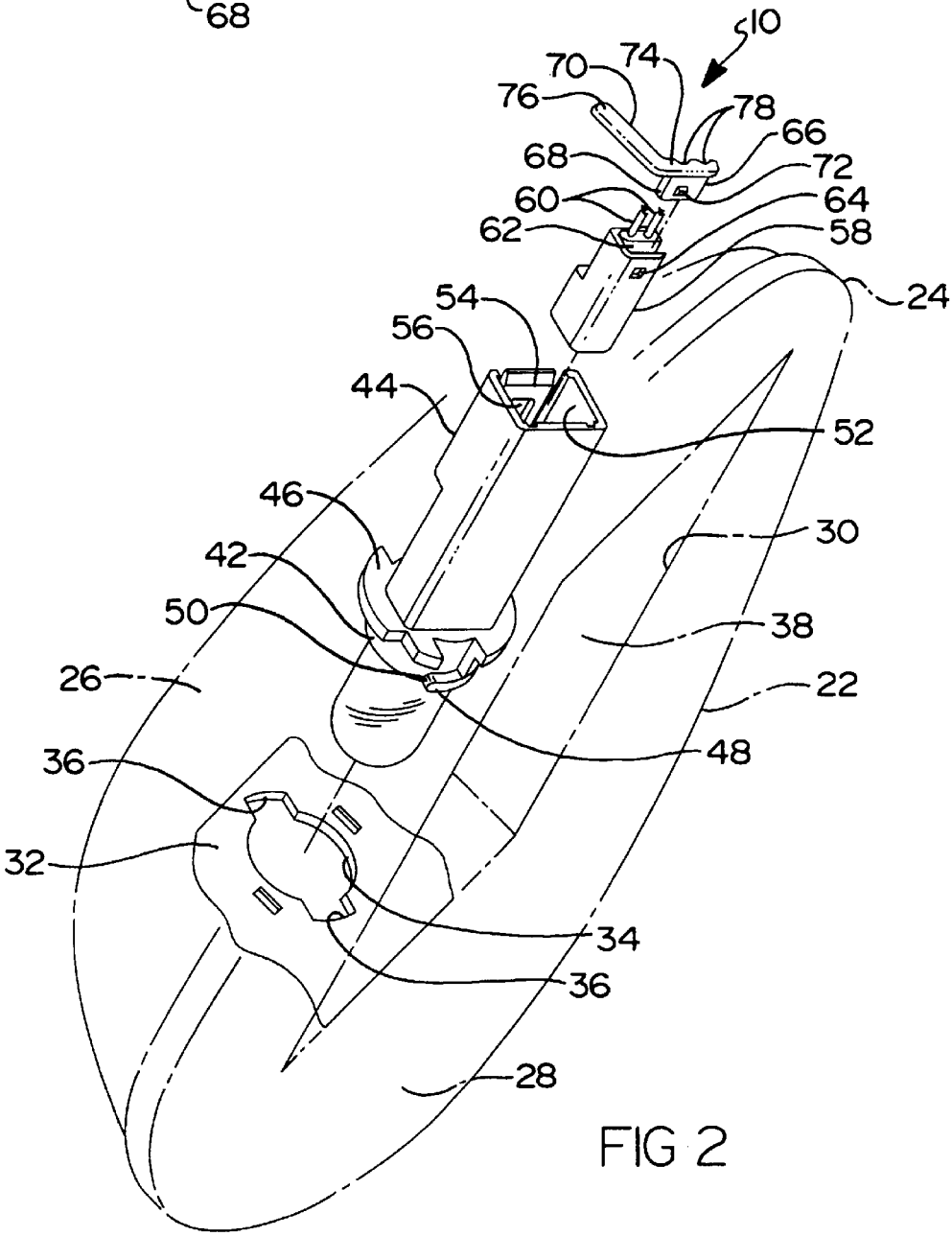
FIG 2

TERMINAL POSITION ASSURANCE ASSEMBLY FOR ROOF MARKER LAMP

TECHNICAL FIELD

The present invention relates generally to fasteners and, more particularly, to a terminal position assurance assembly for a roof marker lamp for a vehicle.

BACKGROUND OF THE INVENTION

It is known to provide a roof marker lamp for a vehicle such as a sport utility vehicle or a pick-up truck. Typically, the roof marker lamp is attached to an outer surface of a roof of the vehicle, The roof marker lamp typically has a bulb socket that resides in a cavity thereof and is attached to a female electrical connector. The roof marker lamp is electrically connected to a power source by wire and a male electrical connector that mates with the female electrical connector. However, during assembly, the wire and male electrical connector are snapped into the female electrical connector in the back of the bulb socket in tight quarters. In addition, due to limited space, it is very difficult to plug the male electrical connector into the female electrical connector in the cavity of the roof marker lamp.

As a result, it is desirable to provide a terminal position assurance assembly for a roof marker lamp for a vehicle. It is also desirable to provide a terminal position assurance assembly that is pre-assembled to an electrical connector for mating with an electrical connector disposed in a cavity of a roof marker lamp of the vehicle. It is further desirable to provide a terminal position assurance assembly for a roof marker lamp that assists an assembler in snapping one electrical connector into the electrical connector behind the bulb socket in the roof marker lamp. Therefore, there is a need in the art to provide a terminal position assurance assembly for a roof marker lamp on a vehicle.

SUMMARY OF THE INVENTION

It is, therefore, one object of the present invention to provide a new terminal position assurance assembly for a roof marker lamp for a vehicle.

It is another object of the present invention to provide a terminal position assurance assembly for a roof marker lamp that is preassembled to an electrical connector for the roof marker lamp.

It is yet another object of the present invention to provide a terminal position assurance assembly for a roof marker lamp that has assists an assembler to in connecting an electrical connector to an electrical connector disposed inside a roof marker lamp during installation.

To achieve the foregoing objects, the present invention is a terminal position assurance assembly for connection to an electrical connector of a roof marker lamp for a vehicle. The terminal position assurance assembly includes an electrical connector for connection to the electrical connector of the roof marker lamp. The terminal position assurance assembly also includes a terminal position assurance member connected to the electrical connector and having a handle portion extending outwardly to be gripped by an assembler to assist the assembler in connecting the electrical connector to the electrical connector of the roof marker lamp.

One advantage of the present invention is that a terminal position assurance assembly is provided for a roof marker lamp for a vehicle. Another advantage of the present invention is that the terminal position assurance assembly clips onto one of the electrical connectors to secure the terminals on the electrical connector into position with an electrical connector of a roof marker lamp of a vehicle. Yet another advantage of the present invention is that the terminal position assurance assembly is pre-assembled to the electrical connector and reduces the number of loose pieces in a vehicle assembly plant. Still another advantage of the present invention is that the terminal position assurance assembly has an integrated handle to assist an assembler in snapping the one electrical connector into the other electrical connector in the roof marker lamp. A further advantage of the present invention is that the terminal position assurance assembly reduces installation time and improves quality due to adequate connection. Yet a further advantage of the present invention is that the terminal position assurance assembly is ergonomically friendly, eliminating two-hand operation and use of pigtail and does not change assembly procedure.

Other objects, features, and advantages of the present invention will be readily appreciated, as the same becomes better understood, after reading the subsequent description taken in conjunction with the accompanying drawings.

BRIEF DESCRIPTION OF THE DRAWINGS

FIG. 1 is a perspective view of a terminal position assurance assembly, according to the present invention, illustrated in operational relationship with a roof marker lamp of a vehicle.

FIG. 2 is an exploded perspective view of the terminal position assurance assembly and roof marker lamp of FIG. 1.

FIG. 3 is a perspective view of a terminal position assurance member of the terminal position assurance assembly of FIGS. 1 and 2.

FIG. 4 is a front elevational view of the terminal position assurance assembly of FIG. 2 installed.

DESCRIPTION OF THE PREFERRED EMBODIMENT

Referring to the drawings and in particular FIGS. 1 through 4, one embodiment of a terminal position assurance assembly 10, according to the present invention, for a roof marker lamp 22 to be described is shown for a vehicle such as a pick-up truck, generally indicated at 12. The vehicle 12 includes a vehicle body 14 forming sides 16 and a roof 18 and including a windshield 20 extending forwardly and downwardly at a front longitudinal end thereof. It should be appreciated that the terminal position assurance assembly 10 may be used on other objects than a roof lamp marker. It should also be appreciated that, except for the terminal position assurance assembly 10, the vehicle 12 is conventional and known in the art.

Referring to FIGS. 2 and 3, the roof marker lamp 22 is generally rectangular in shape. The roof marker lamp 22 has a base 24 and a lens 26 disposed over the base 24. The base 24 has a bottom surface 28 and an aperture 30 extending through the bottom surface 28. The aperture 30 is generally rectangular in shape. The base 24 also has an interior wall 32 extending upwardly and generally perpendicular to the bottom surface 28 adjacent the aperture 30. The interior wall 32 has an aperture 34 extending therethrough. The aperture 34 is generally circular in shape with opposed flange portions 36 extending outwardly into the interior wall 32 for a function to be described. The base 24 has a plurality of apertures (not shown) spaced along a periphery thereof for a function to be described. The base 24 is made of a rigid material such as a plastic material, preferably polycarbonate. The base 24 includes a seal (not shown) such as a rubber gasket extending around the periphery of the base 24 for engagement with the outer surface of the roof 18. It should be appreciated that the seal is conventional and known in the art.

The lens 26 is generally rectangular in shape and has a generally arcuate or curved cross-sectional shape. The lens 26 is disposed over the base 24 to form a cavity 38 therein. The lens 26 also has a plurality of apertures 40 spaced along a periphery thereof and aligned with the apertures 32 of the base 24. The lens 26 is made of a rigid material such as a plastic material, preferably polycarbonate. It should be appreciated that the roof marker lamp 22 is conventional and known in the art.

The roof marker lamp 22 also includes a bulb socket 42 for a lamp or bulb (not shown) and an electrical connector 44 connected to the bulb socket 42. The bulb socket 42 includes a flange 46 extending radially outwardly and a projection 48 spaced axially between the flange 46 and the end of the bulb socket 42 extending radially to form a groove 50 between the flange 46 and projection 48 for receiving a portion of the interior wall 32. The electrical connector 44 is of a female type. The electrical connector 44 extends axially from the bulb socket 44 and has a cavity 52 extending axially inwardly and having a plurality of terminals (not shown) therein connected to the bulb socket 42 and for connection to the terminal position assurance assembly 10. The electrical connector 44 has a flexible latch member 54 which may be deflected to allow a projection to be disposed in a slot 56 therein. It should be appreciated that the bulb socket 42 and electrical connector 44 are conventional and known in the art.

The terminal position assurance assembly 10, according to the present invention, includes an electrical connector 58 for mating engagement with the electrical connector 44. The electrical connector 58 is of a male type and has a plurality of passages (not shown) with terminals therein for receiving the terminals of the electrical connector 44. The terminals of the electrical connector 58 are connected to wires 60 which are, in turn, connected to a power source (not shown). The electrical connector 58 also includes a projection (not shown) extending outwardly for engagement with the latch member 54 and to be disposed in the slot 56 of the latch member 54 to prevent the electrical connector 58 from disengaging the electrical connector 44. The electrical connector 58 also includes a slot 62 extending axially into one end thereof. The electrical connector 58 also includes an aperture 64 extending through a wall thereof and communicating with the slot 62 for a function to be described.

The terminal position assurance assembly 10 further includes a terminal position assurance member 66 for mating engagement with the electrical connector 58. The terminal position assurance member 66 includes a base portion 68 and a handle portion 70. The base portion 68 is generally rectangular in shape and has a projection 72 extending outwardly to be disposed in the aperture 64 of the electrical connector 58. The handle portion 70 is generally shaped like a hockey stick and has a first portion 74 extending along a side of the base portion 68 and a second portion 76 extending outwardly from the first portion 74. The first portion 74 may have one or more recesses 78 to receive the wires 60 therein. The terminal position assurance member 66 is made of a plastic material and may be colored a color different from the electrical connector 58. The terminal position assurance member 66 is a monolithic structure being integral, unitary, and one-piece.

In operation of the terminal position assurance assembly 10, the lens 26 is disposed over the base 24 of the roof marker lamp 22. The bulb socket 42 is extended through the aperture 34 of the interior wall 32 and rotated such that the interior wall 32 is disposed in the groove 50 between the flange 46 and the projection 48. The terminal position assurance member 66 is clipped into the electrical connector 58 such that the base member 68 is disposed in the slot 62 and moved to deflect the wall thereof and allow the projection 72 to be snapped into and disposed in the aperture 64. It should be appreciated that the terminal position assurance member 66 is pre-assembled to the electrical connector 58 to form the terminal position assurance assembly 10 before being installed in the roof marker lamp 22. It should also be appreciated that the wires 60 may be taped to the handle portion 70 of the terminal position assurance assembly 10.

Once the terminal position assurance assembly 10 is pre-assembled, an assembler grips the handle portion 70 of the terminal position assurance member 66 and moves the electrical connector 58 into the cavity 38 of the roof marker lamp 22. The electrical connector 58 is moved by the assembler gripping the handle portion 70 with their fingers and disposed in the cavity 52 of the electrical connector 44 such that the projection engages the latch member 54 and snaps into the groove 56. It should be appreciated that the a portion of the handle portion 70 extends out of the cavity 36 through the aperture 34 to allow the assembler's fingers to manipulate the terminal position assurance assembly 10.

Fasteners (not shown) are extended through the apertures 40 of the lens 26 and rotated to threadably engage retainers (not shown). The roof marker lamp 22 is disposed adjacent the roof 18 such that the retainers snap into the apertures (not shown) in the roof 18 and engage the roof 18. The fasteners are completely torqued one at a time, with the sequence being irrelevant. The retainers move outwardly and expand to engage the roof 18 to secure the roof marker lamp 22.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A terminal position assurance assembly for connection to a first electrical connector of a roof marker lamp for a vehicle comprising:

a second electrical connector for connection to the first electrical connector of the roof marker lamp, said second electrical connector having a slot extending axially into one end thereof; and a terminal position assurance member having a base portion to be disposed in said slot of said second electrical connector and having a handle portion extending outwardly from said base portion to be gripped by an assembler to assist the assembler in connecting said second electrical connector to the first electrical connector of the roof marker lamp.

2. A terminal position assurance assembly as set forth in claim 1 wherein said terminal position assurance member is made of a plastic material.

3. A terminal position assurance assembly as set forth in claim 1 wherein said terminal position assurance member is of a color different from said second electrical connector.

4. A terminal position assurance assembly as set forth in claim 1 wherein said second electrical connector has an aperture extending through a wall thereof and communicating with said slot.

5. A terminal position assurance assembly as set forth in claim 4 wherein said base portion has a projection extending outwardly and disposed in said aperture.

6. A terminal position assurance assembly as set forth in claim 4 wherein said base portion and said handle portion are integral, unitary, and one-piece.

7. A terminal position assurance assembly as set forth in claim 4 wherein said handle portion comprises a first portion extending along a side of said base portion and a second portion extending outwardly at an angle from said first portion.

8. A terminal position assurance assembly as set forth in claim 7 wherein said first portion has at least one recess therein to receive at least one wire therein.

9. A roof marker lamp assembly for a vehicle comprising:

a roof marker lamp having a cavity and a first electrical connector disposed in said cavity;

a second electrical connector for connection to said first electrical connector, said second electrical connector having a slot extending axially into one end thereof; and a terminal position assurance member having a base portion to be disposed in said slot of said second electrical connector and having a handle portion extending outwardly from said base portion to be gripped by an assembler to assist the assembler in connecting said second electrical connector to said first electrical connector of said roof marker lamp.

10. A roof marker lamp assembly as set forth in claim 9 wherein said second electrical connector has an aperture extending through a wall thereof and communicating with said slot.

11. A roof marker lamp assembly as set forth in claim 10 wherein said base portion has a projection extending outwardly and disposed in said aperture.

12. A roof marker lamp assembly as set forth in claim 9 wherein said handle portion comprises a first portion extending along a side of said base member and a second portion extending outwardly at an angle from said first portion.

13. A roof marker lamp assembly as set forth in claim 12 wherein said first portion has at least one recess therein to receive at least one wire therein.

14. A roof marker lamp assembly as set forth in claim 13 wherein said base portion and said handle portion are integral, unitary, and one-piece.

15. A roof marker lamp assembly as set forth in claim 14 wherein said terminal position assurance member is made of a plastic material.

16. A roof marker lamp assembly for a vehicle comprising:

a roof marker lamp comprising a base disposed adjacent a roof of the vehicle and a lens disposed over said base to form a cavity therein;

said roof marker lamp includes a bulb socket disposed in said cavity and a first electrical connector connected to said bulb socket and disposed in said cavity;

a second electrical connector for connection to said first electrical connector, said second electrical connector having has a slot extending axially into one end thereof; and a terminal position assurance member having a base portion disposed in said slot and a handle portion extending outwardly from said base portion to be gripped by an assembler to assist the assembler in connecting said second electrical connector to said first electrical connector of said roof marker lamp.

* * * * *